US010857422B2

(12) United States Patent
Okubadejo

(10) Patent No.: US 10,857,422 B2
(45) Date of Patent: Dec. 8, 2020

(54) CORE STRENGTHENING EXERCISE EQUIPMENT

(71) Applicant: Gbolahan O Okubadejo, Edgewater, NJ (US)

(72) Inventor: Gbolahan O Okubadejo, Edgewater, NJ (US)

( * ) Notice: Subject to any disclaimer, the term of this patent is extended or adjusted under 35 U.S.C. 154(b) by 32 days.

(21) Appl. No.: 16/248,969

(22) Filed: Jan. 16, 2019

(65) Prior Publication Data

US 2019/0224523 A1 Jul. 25, 2019

Related U.S. Application Data

(60) Provisional application No. 62/619,649, filed on Jan. 19, 2018.

(51) Int. Cl.

| | |
|---|---|
| ***A63B 22/20*** | (2006.01) |
| ***A63B 21/055*** | (2006.01) |
| ***A63B 21/00*** | (2006.01) |
| ***A63B 23/035*** | (2006.01) |
| ***A63B 23/12*** | (2006.01) |
| ***A63B 21/04*** | (2006.01) |

(52) U.S. Cl.

CPC ..... *A63B 22/20* (2013.01); *A63B 21/00061* (2013.01); *A63B 21/0442* (2013.01); *A63B 21/0552* (2013.01); *A63B 21/4034* (2015.10); *A63B 21/4043* (2015.10); *A63B 23/03541* (2013.01); *A63B 23/1236* (2013.01); *A63B 21/4049* (2015.10); *A63B 2208/0295* (2013.01)

(58) Field of Classification Search

CPC . A63B 22/20; A63B 21/0442; A63B 23/1236; A63B 23/03541; A63B 21/4034; A63B 21/00061; A63B 21/4043; A63B 21/4015; A63B 21/4035; A63B 21/0522; A63B 2208/0295; A63B 21/4049

See application file for complete search history.

(56) References Cited

U.S. PATENT DOCUMENTS

| | | | | |
|---|---|---|---|---|
| 3,809,393 | A * | 5/1974 | Jones | A63B 22/20 482/132 |
| D523,493 | S * | 6/2006 | Horton | D21/662 |
| 9,358,419 | B1 * | 6/2016 | Smith | A63B 23/1209 |
| 9,539,465 | B2 * | 1/2017 | Agostini | A63B 26/003 |
| 2002/0155932 | A1 * | 10/2002 | Ilic | A63B 22/20 482/140 |

(Continued)

*Primary Examiner* — Jennifer Robertson
*Assistant Examiner* — Catrina A Letterman
(74) *Attorney, Agent, or Firm* — Lawrence B. Goodwin; Mandelbaum Salsburg P.C.

(57) ABSTRACT

Apparatus for facilitating core exercises comprises, in combination, a pair of rolling handgrips, each of the rolling handgrips comprising a base having an upper side and an underside, a gripping bar connected to the base and adapted to allow a user to grip the rolling handgrip, and at least three wheels mounted on the underside of the base, each of said wheels providing a 360° freedom of movement, such that the rolling handgrip provides a 360° freedom of movement when the wheels are placed on a floor surface, and a board adapted to be mounted on the pair of rolling handgrips, whereupon, when the board is mounted upon the pair of rolling handgrips, the board provides 360° freedom of movement on the floor surface.

9 Claims, 5 Drawing Sheets

(56) References Cited

U.S. PATENT DOCUMENTS

| | | | | |
|---|---|---|---|---|
| 2014/0018217 | A1* | 1/2014 | Brown | A63B 23/0355<br>482/132 |
| 2016/0287932 | A1* | 10/2016 | Brown | A63B 21/068 |
| 2017/0072258 | A1* | 3/2017 | Chen | A63B 23/03525 |
| 2019/0030393 | A1* | 1/2019 | Petersen | A63B 21/068 |
| 2019/0143168 | A1* | 5/2019 | Chang | A63B 23/0211<br>482/138 |

* cited by examiner

CORE STRENGTHENING EXERCISE EQUIPMENT

CROSS-REFERENCE TO RELATED APPLICATION

This application claims priority to provisional application Ser. No. 62/619,649, filed Jan. 19, 2018, the entire disclosure of which is hereby incorporated by reference.

FIELD OF THE INVENTION

The present invention is directed to core strengthening exercise equipment, and in particular, a combination of devices that are used together in a variety of different configurations to exercise the core and upper body.

BACKGROUND

Core strengthening exercises have become widely accepted as an important exercise regimen. Such exercises strengthen core muscles, including abdominal muscles, back muscles and the muscles around the pelvis. The core muscles keep people upright, balanced, and mobile. Strong core muscles lead to better balance and stability, making it easier to do many physical activities. Thus, strong core muscles are important to achieve and maintain.

Although core exercises can be done, to some extent, without specialized equipment, equipment specifically designed to facilitate core exercises can improve the quality and efficiency of core strengthening exercises. However, existing core exercise devices have been generally lacking insofar as they either may not accommodate or facilitate a full range of high-quality routines, or they are unduly complicated and unwieldy.

SUMMARY OF THE INVENTION

Accordingly, it is an object of the present invention to provide modular core strengthening apparatus that provides a full, comprehensive range of efficient core strengthening exercises and yet is compact, easily used and assembled.

In accordance with a first aspect of the invention, apparatus for facilitating core exercises comprises, in combination,

- a pair of rolling handgrips, each of the rolling handgrips comprising a base having an upper side and an underside, a gripping bar connected to the base and adapted to allow a user to grip the rolling handgrip, and at least three wheels mounted on the underside of the base, each of said wheels providing a 360° freedom of movement, such that the rolling handgrip provides a 360° freedom of movement when the wheels are placed on a floor surface, and
- a board adapted to be mounted on the pair of rolling handgrips, the board comprising an upper board surface, a lower board surface, a plurality of mounting brackets connected to the lower board surface, the plurality of mounting brackets adapted to contact the pair of rolling handgrips, to facilitate the secure mounting of the board upon the pair of rolling handgrips, whereupon, when the board is mounted upon the pair of rolling handgrips, the board provides 360° freedom of movement on the floor surface.

The board can be provided with at least one finger slot to facilitate the gripping of the board by said user's hands. The board can also include at least one cushioning pad adjacent the finger slot adapted to cushion said user's wrists. Preferably, each each of the rolling handgrips has three wheels. For each rolling handgrip, the gripping bar can be connected to the base by a vertical support on each end of the gripping bar. Preferably, first and second mounting brackets are provided for each of the pair of rolling handgrips, the first mounting bracket is adapted to engage one of the vertical supports, and the second mounting bracket is adapted to engage the gripping bar.

The apparatus can further include a pair of elastic straps adapted to be connected at one end to the board and at the other end to the user's feet. The apparatus can also include a pair of appliances adapted to support the pair of rolling handgrips to prevent the rolling handgrips from moving when placed on the floor surface.

These and other objects and aspects of the present invention will be described in more detail with reference to the following drawings.

DETAILED DESCRIPTION

Figure 1:
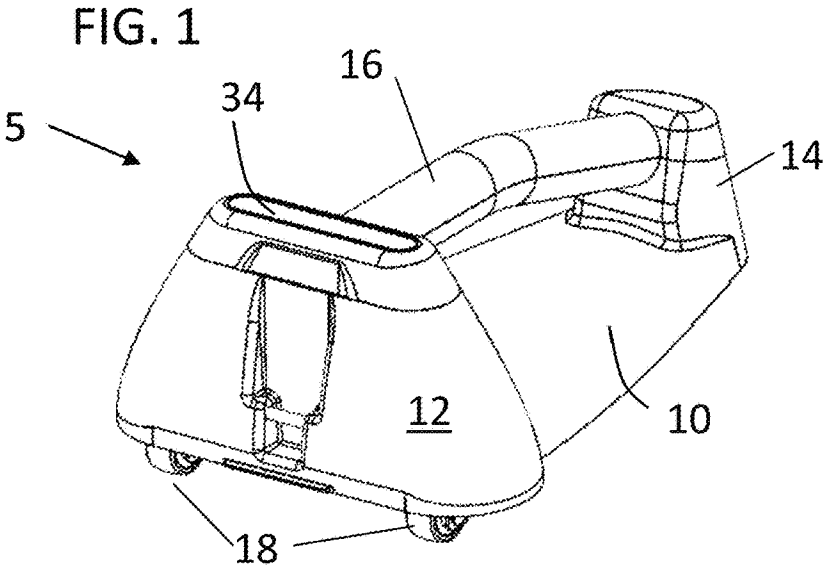
FIG. 1 is an illustration of the rolling handgrip in accordance with the present invention.
Figure 1A:
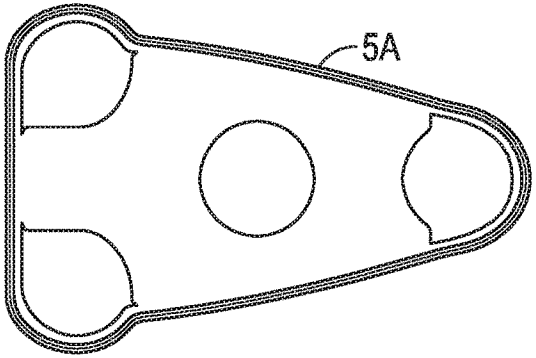
FIG. 1A is an illustration of an appliance that may be used to immobilize the rolling handgrip, if desired.

FIG. 1 illustrates the rolling handgrip 5 in accordance with one aspect of the present invention. The rolling handgrip is comprised of a base 10, large vertical support 12, a small vertical support 14, and a gripping bar 16, which is contoured to facilitate a comfortable grip. The gripping bar 16 is supported on one side by the large vertical support 12 and on the other side by the small vertical support 14. Mounted on the underside of the base 10 are three wheels, two of which are located under the large vertical support 12, and another of which (not shown) is located under the small vertical support 14. All of the wheels 18 are rotatable through a 360° range of motion (meaning forward and back, side to side, and all directions in-between) so that the handgrip 5 is similarly capable of a 360° range of motion. If desired, a flat, non-rolling appliance 5*a*, FIG. 1A, upon which the handgrip may be placed, may be provided to prevent the handgrip from rolling.

Figure 2A:
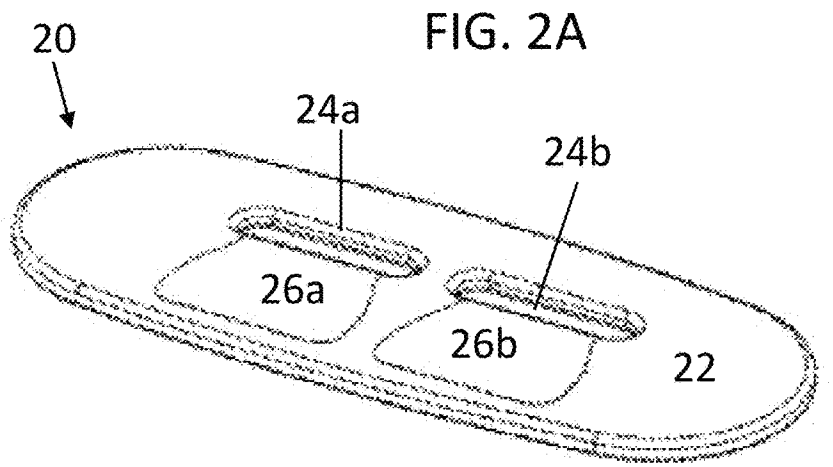
FIG. 2A is an illustration of the top surface of the board in accordance with the present invention.
Figure 2B:
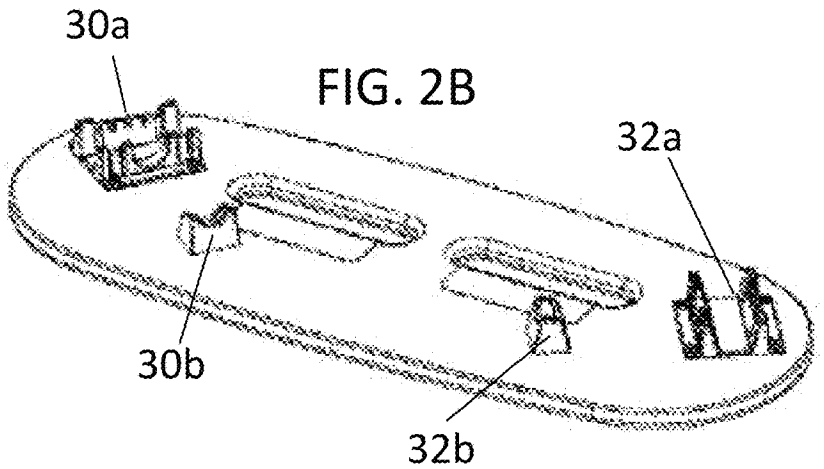
FIG. 2B is an illustration of the bottom surface of the board in accordance with the present invention.
Figure 3:
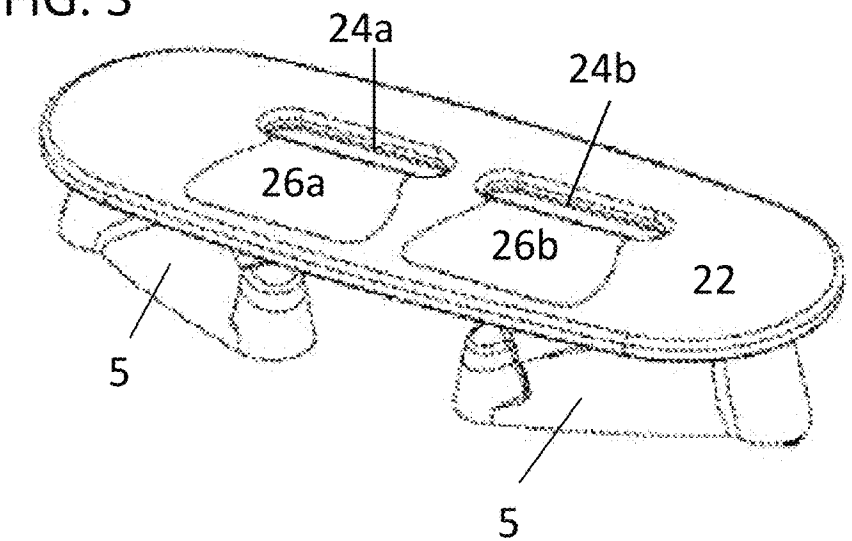
FIG. 3 is an illustration of the board of FIGS. 2A and 2B mounted upon a pair of rolling handgrips, one of which is shown in FIG. 1.

Two of the rolling handgrips 5 are designed to work in conjunction with board 20, FIGS. 2A and 2B, which is generally oblong and comprised of a generally flat top surface 22, finger slots 24*a* and 24*b*, and wrist pads 26*a* and 26*b*, which provide cushioning for the user's wrists, as best shown in FIG. 2A. As shown in FIG. 2B, the bottom surface 28 of the board 20 is provided with mounting brackets 30*a* and 30*b* on one end of the board, and brackets 32*a* and 32*b* on the other end. As shown in FIG. 1, the large vertical support 12 of the rolling handgrip is provided with a transverse tab 34 which is adapted to fit securely within one of brackets 30*a* and 32*a*, and a portion of the gripping bar, proximal to the small vertical support 14, is adapted to fit securely within one of brackets 30*b* and 32*b*, such that the board 20 can be placed upon, and securely connected to, two rolling handgrips, as shown in FIG. 3.

Figure 4B:
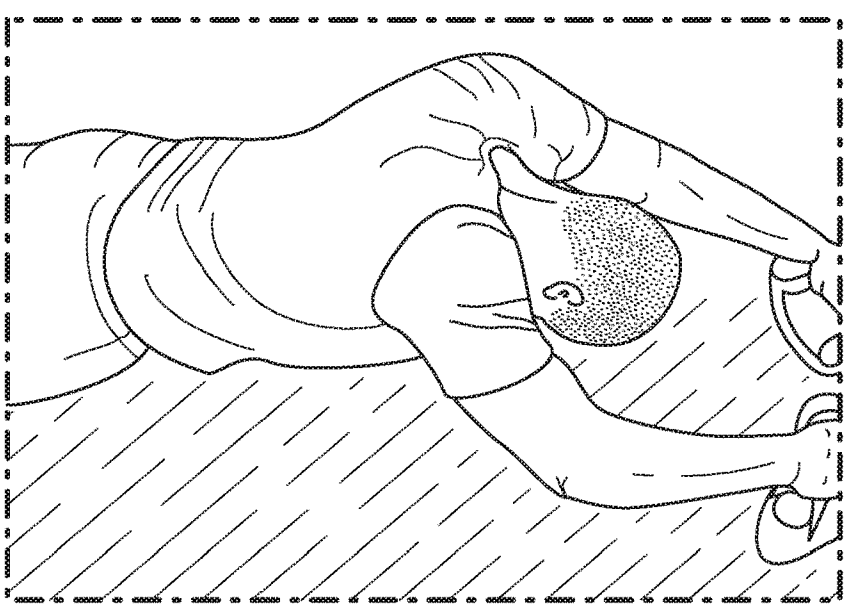
FIGS. 4A and 4B illustrate a core exercise using the rolling handgrips.
Figure 4A:
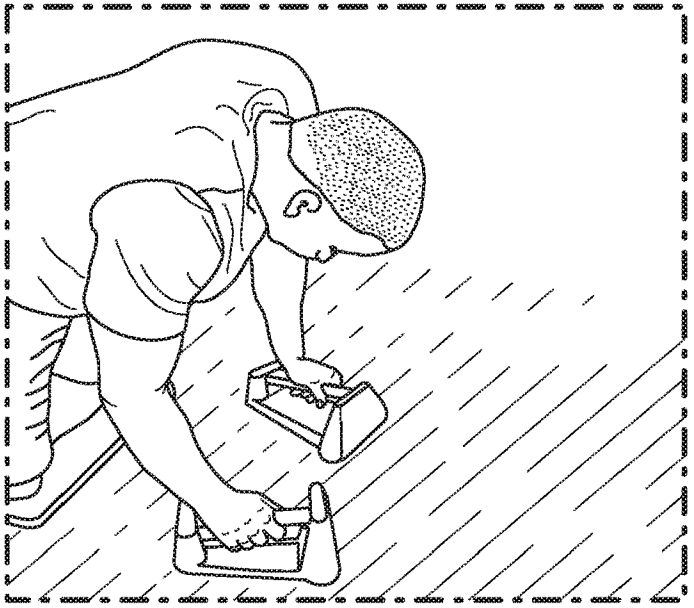

In operation, the rolling handgrips 5 can be used with or without the board 20, in the following manner. First, as shown in FIGS. 4A and 4B, the pair of rolling handgrips 5 can be used without the board 20. In this case, the user's feet or knees can be placed on a stationary mat, pad or the like, and the user will grip each of the rolling handgrips in his or her hands. As shown in FIG. 4A, the user can retract his or her midsection toward the knees, and as shown in FIG. 4B, the user can extend his or her midsection outwardly. These steps of extension and retraction can be repeated several times to efficiently exercise the user's core muscles. Moreover, because the rolling handgrips 5 roll independently of each other, and because they are capable of a full 360° rotation, the user can extend her or her midsection laterally, from side to side, and further, can laterally separate his or her arms during the extension and/or retraction exercises. Thus, the use of the rolling handgrips 5, by themselves, provides a multitude of core exercise options and capabilities for the user.

Figure 5B:
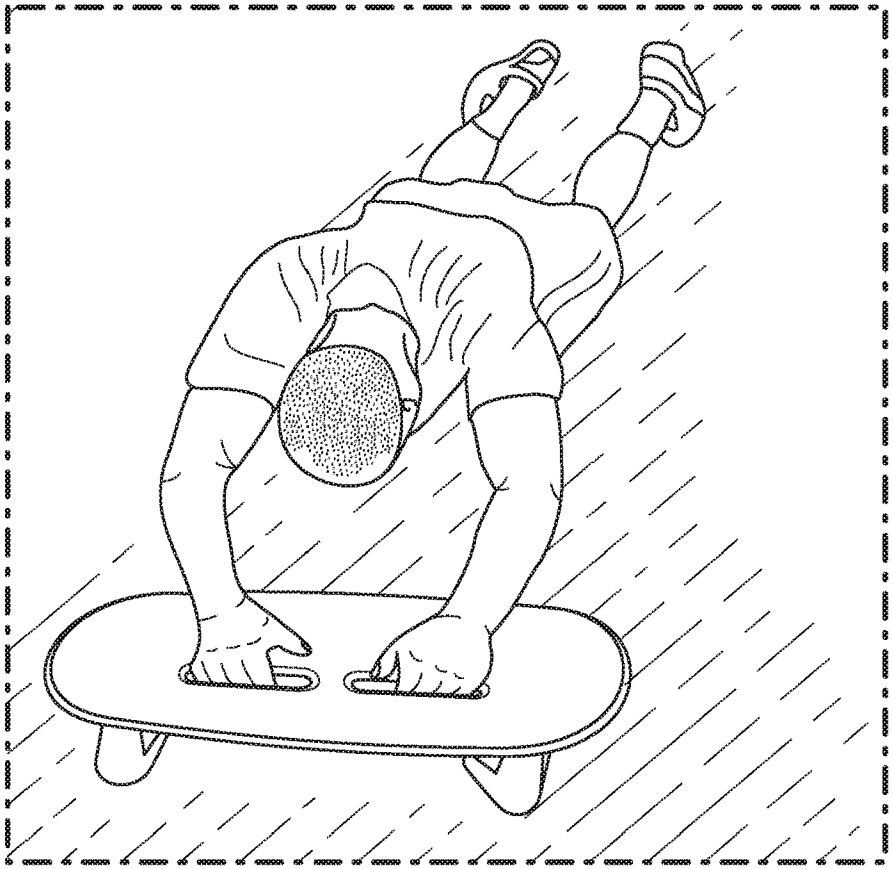
FIGS. 5A and 5B illustrate a core exercise with the user's hands gripping the board.
Figure 5A:
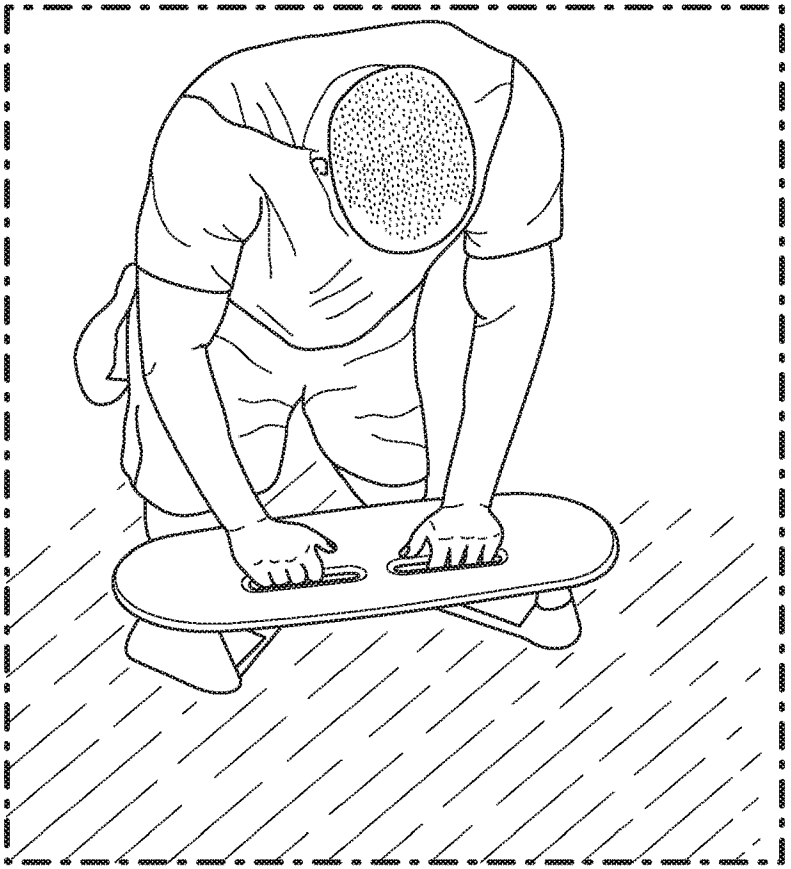
Figure 6B:
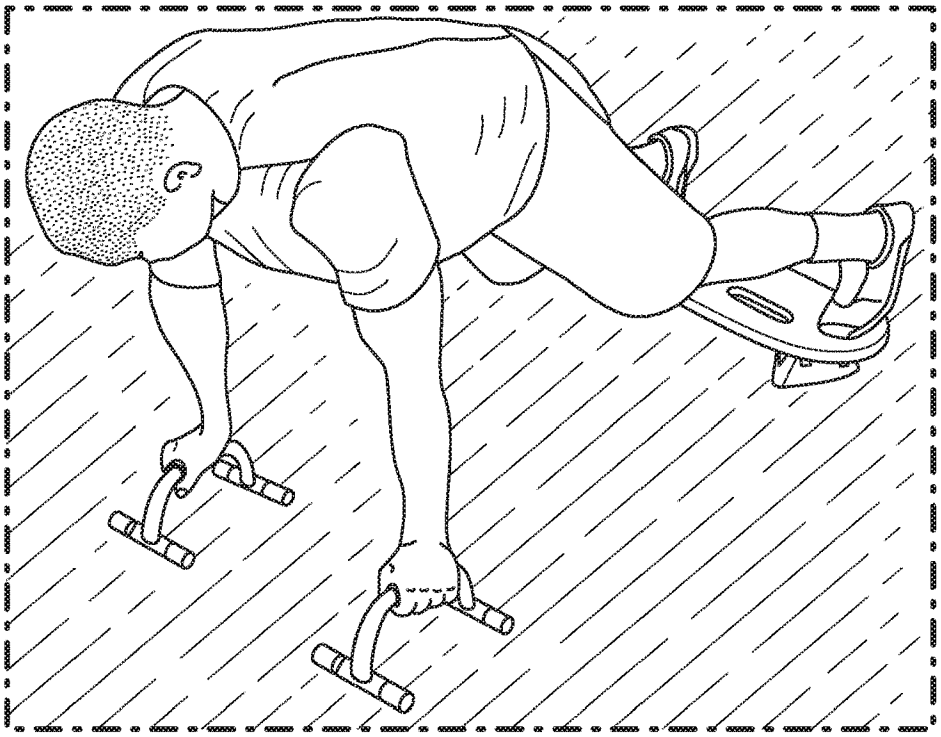
FIGS. 6A and 6B illustrate a core exercise with the user's feet on the board.
Figure 6A:
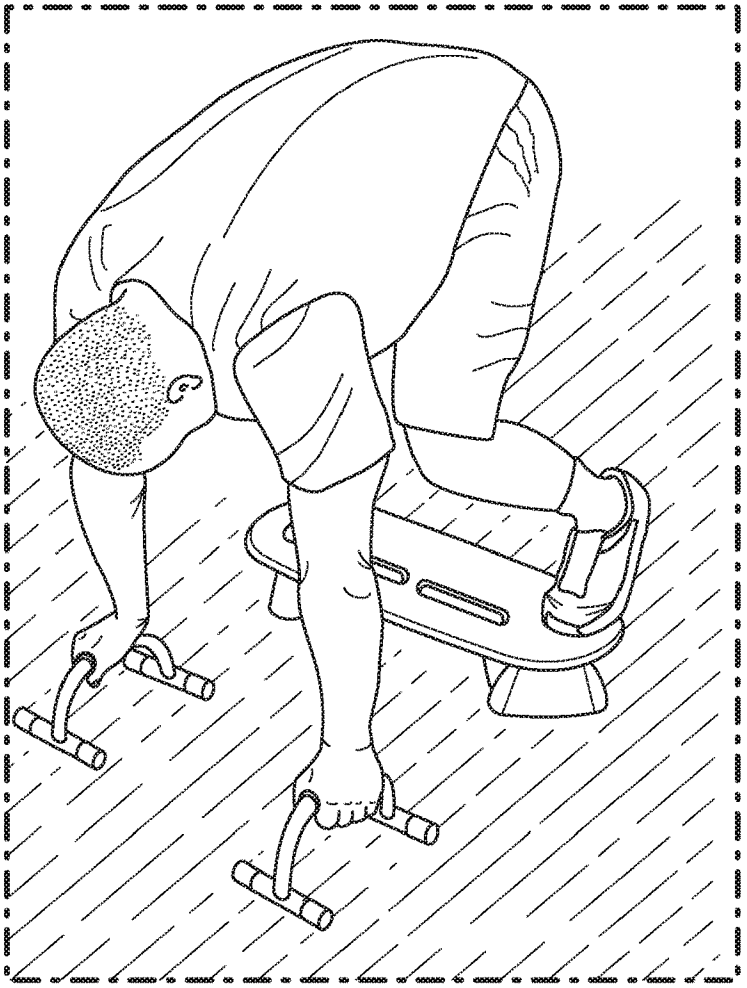

As mentioned above, the rolling handgrips 5 can also be used in combination with the board 20, as follows. By placing the board 20 on top of two handgrips 5 so that they are securely located within brackets 30*a*, 30*b*, 32*a* and 32*b*, the board is capable of a full 360° rotation. The user then can place either his/her hands on the board as shown in FIGS. 5A and 5B, with the user's fingers inserted into the finger slots 24*a* and 24*b* and wrists resting on the pads 26*a* and 26*b*, or his/her feet on the board as shown in FIGS. 6A and 6B. The user can then repeatedly extend and retract his or her midsection, by moving his or her arms, in the case of FIGS. 5A and 5B, or his or her legs, in the case of FIGS. 6A and 6B. Although in these cases the user's arms or legs must move together, the user can extend his or her midsection laterally, from side to side, by virtue of the 360° rotation provided by rolling handgrips 5. Thus, the use of the rolling handgrips 5 in combination with the board 20 provides a multitude of additional core exercise options and capabilities for the user.

Figure 7A:
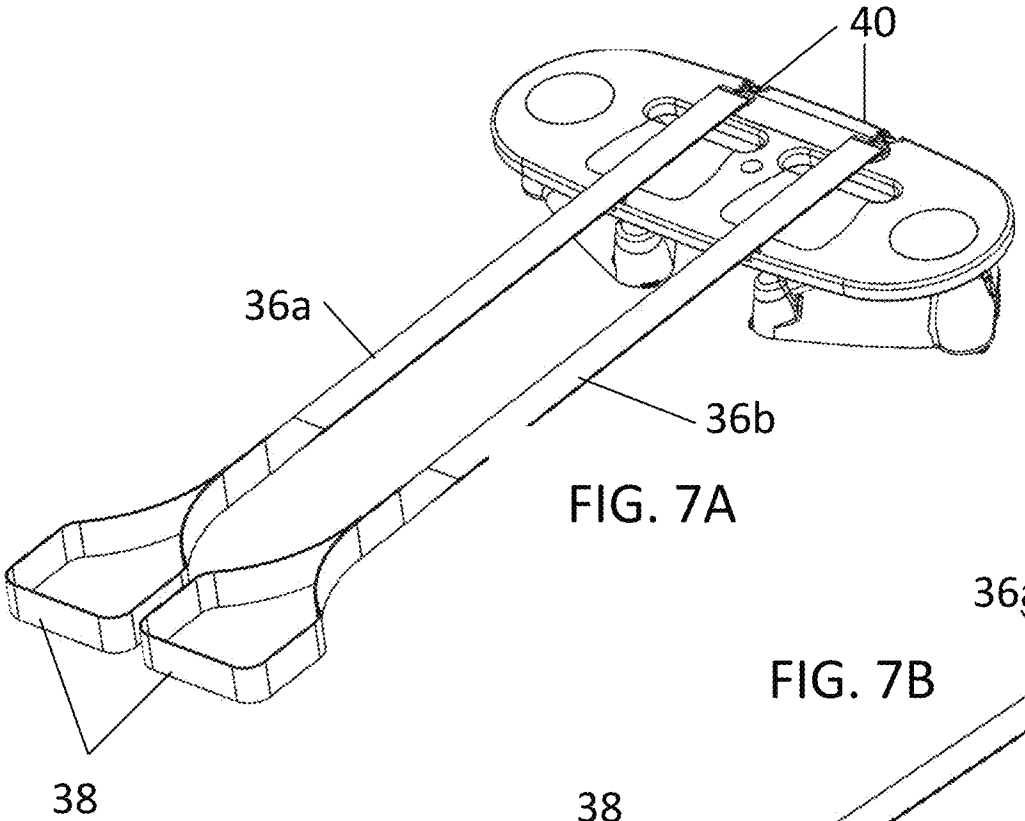
FIGS. 7A and 7B illustrate elastic bands attached to the board.
Figure 7B:
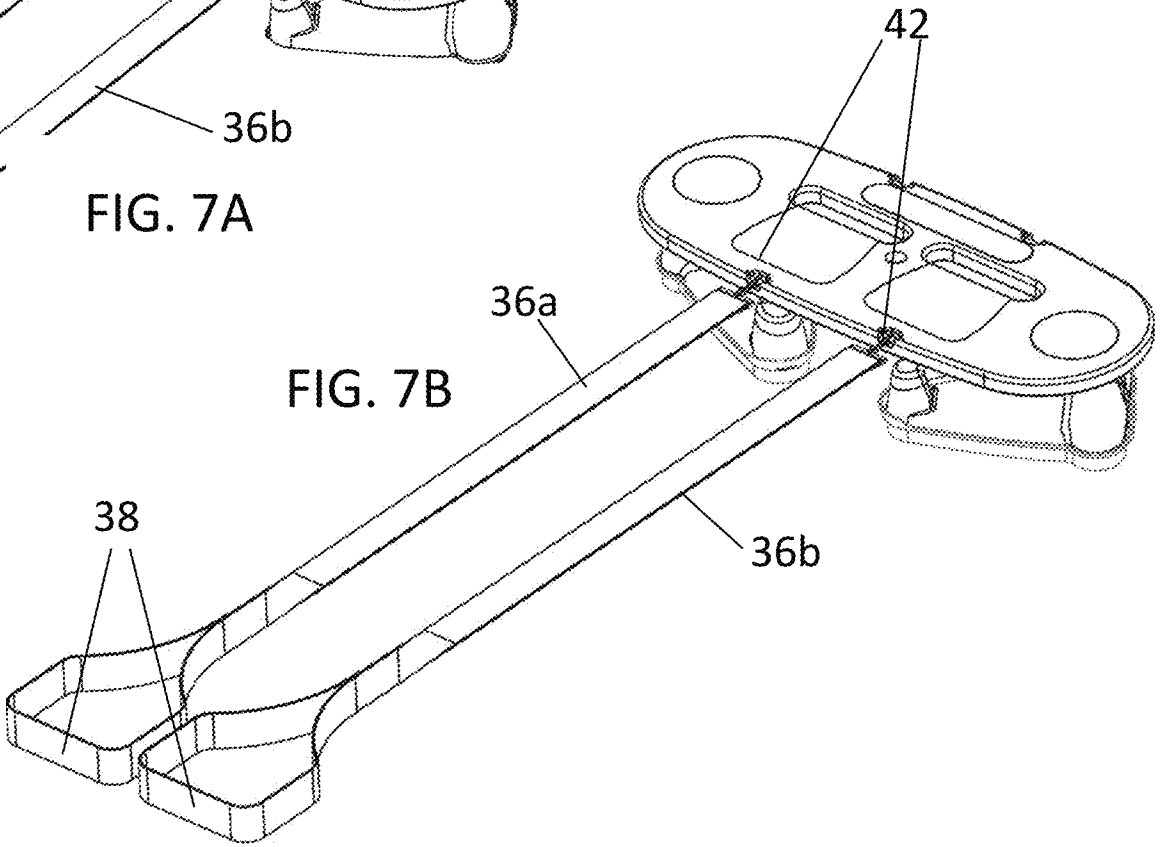

Additional capabilities can be provided through the use of elastic bands 36*a*, 36*b*, as shown in FIGS. 7A and 7B. In the event the user wishes to increase the force required for extension while doing the exercises shown in FIGS. 5A and 5B, the user can attach the elastic bands to the board at either distal connection points 40 on the board (FIG. 7A) or proximal connection points 42 on the board (FIG. 7B). The user then inserts his or her feet into the loops 38 located on the ends of the elastic bands. By doing so, more force will be required by the user to extend his or her midsection due to the resistive force of the bands. Bands of different elasticities can be provided to vary the amount of additional force required for this extension.

It will be understood that various changes in the details, materials and arrangements of parts which have been herein described and illustrated in order to explain the nature of the invention may be made by those skilled in the art within the principle and scope of the invention as expressed in the following claims.

What I claim is:

1. Apparatus for facilitating core exercises, comprising, in combination, a. a pair of rolling handgrips, each of said rolling handgrips comprising
   i. a base having an upper side and an underside;
   ii. a gripping bar connected to said base and adapted to allow a user to grip said rolling handgrip; and
   iii. at least three wheels mounted on said underside of said base, each of said wheels providing a 360° freedom of movement, such that said rolling handgrip provides a 360° freedom of movement when said wheels are placed on a floor surface;
   wherein each of said rolling handgrips has three of said wheels, and wherein, for each rolling handgrip, said gripping bar is contoured and connected to said base by first and second vertical supports on respective ends of said gripping bar, said first and second vertical supports having different vertical dimensions to accommodate said contoured gripping bar;

b. a board adapted to be mounted on said pair of rolling handgrips, said board comprising:
   i. an upper board surface;
   ii. a lower board surface;
   iii. a plurality of mounting brackets connected to said lower board surface, said plurality of mounting brackets adapted to contact said pair of rolling handgrips, to facilitate the secure mounting of said board upon said pair of rolling handgrips;

c. whereupon, when said board is mounted upon said pair of rolling handgrips, said board provides 360° freedom of movement on said floor surface.

2. The apparatus of claim 1, wherein said board is provided with at least one finger slot to facilitate the gripping of said board by said user's hands.

3. The apparatus of claim 2, wherein said board further comprises at least one cushioning pad adjacent said finger slot adapted to cushion said user's wrists.

4. The apparatus of claim 1, wherein said plurality of mounting brackets comprises first and second mounting brackets for each of said pair of rolling handgrips.

5. The apparatus of claim 4, wherein said first mounting bracket is adapted to engage one of said vertical supports.

6. The apparatus of claim 5 wherein said second mounting bracket is adapted to engage said gripping bar.

7. The apparatus of claim 1, further comprising a pair of elastic straps adapted to be connected at one end to said board and at another end to said user's feet.

8. The apparatus of claim 1, further comprising a pair of appliances adapted to support said pair of rolling handgrips and prevent said rolling handgrips from moving when placed on said floor surface.

9. Apparatus for facilitating core exercises, comprising, in combination, a. a pair of rolling handgrips, each of said rolling handgrips comprising
   i. a base having an upper side and an underside;
   ii. a gripping bar connected to said base and adapted to allow a user to grip said rolling handgrip; and
   iii. at least three wheels mounted on said underside of said base, each of said wheels providing a 360° freedom of movement, such that said rolling handgrip provides a 360° freedom of movement when said wheels are placed on a floor surface;

b. a board adapted to be mounted on said pair of rolling handgrips, said board comprising:

i. an upper board surface;

ii. a lower board surface;

iii. a plurality of mounting brackets connected to said lower board surface, said plurality of mounting brackets adapted to contact said pair of rolling handgrips, to facilitate the secure mounting of said board upon said pair of rolling handgrips;

c. whereupon, when said board is mounted upon said pair of rolling handgrips, said board provides 360° freedom of movement on said floor surface, and d. wherein, for each rolling handgrip, said gripping bar is contoured and connected to said base by first and second vertical supports on respective ends of said gripping bar, said first and second vertical supports having different vertical dimensions to accommodate said contoured gripping bar.

* * * * *